US006358896B1

(12) United States Patent
Gutierrez et al.

(10) Patent No.: US 6,358,896 B1
(45) Date of Patent: Mar. 19, 2002

(54) FRICTION MODIFIERS FOR ENGINE OIL COMPOSITION

(75) Inventors: Antonio Gutierrez, Mercerville; Rolfe J. Hartley, Cranbury, both of NJ (US)

(73) Assignee: Infineum International Ltd. (GB)

( * ) Notice: Subject to any disclaimer, the term of this patent is extended or adjusted under 35 U.S.C. 154(b) by 38 days.

(21) Appl. No.: 09/731,153

(22) Filed: Dec. 6, 2000

(51) Int. Cl.[7] ..... C10M 133/16; C10M 129/68

(52) U.S. Cl. ..... 508/501; 508/551; 508/555; 560/174

(58) Field of Search ..... 508/555, 501; 560/174

(56) References Cited

U.S. PATENT DOCUMENTS 4,305,833 A * 12/1981 Roberts ..... 252/51.5 A
4,366,076 A * 12/1982 Clark ..... 252/34
4,495,077 A * 1/1985 Powell et al. ..... 252/51.5 A
4,557,846 A * 12/1985 Wisotsky ..... 252/51.5 A
4,701,553 A * 10/1987 Powell ..... 562/504
4,839,072 A 6/1989 Gutierrez et al. ..... 252/51.5 A
5,194,671 A * 3/1993 Meier ..... 560/126
5,945,559 A * 8/1999 Sotoguchi et al. ..... 560/174
6,057,273 A * 5/2000 Oumar-Mahamat et al. ..... 508/551
6,222,063 B1 * 4/2001 Zimmermann et al. ..... 560/174

* cited by examiner

*Primary Examiner*—Ellen M. McAvoy

(57) ABSTRACT

A lubricating oil composition which exhibits improved fuel economy and fuel economy retention which contains keto-amide and keto-ester friction modifiers formed by reaction or trans-esterification of alkyl acetoacetates. The trans-esterified products are also novel compositions of matter.

10 Claims, No Drawings

FRICTION MODIFIERS FOR ENGINE OIL COMPOSITION

This invention relates to lubricating oils particularly useful for passenger car engines. More particularly, the invention relates to lubricating oil compositions which exhibit improvements in fuel economy and fuel economy retention through use of certain friction modifiers.

The present invention is based on the discovery that the use of certain derivatives of alkyl acetoacetates as friction modifiers can provide increases in fuel economy as well as fuel economy retention as observed by coefficient of friction studies for lubricating oils containing these additives.

U.S. Pat. No. 4,839,072, issued Jun. 13, 1989 to Gutierrez et al. discloses the use of a polyolefinic succinimide polyamine alkyl acetoacetate adducts as additives for lubricants, including use as friction modifiers.

In accordance with the invention there has been discovered a lubricating oil composition which comprises an oil of lubricating viscosity and a friction modifier selected from the group consisting of (a) a keto-amide formed by reacting an alkyl acetoacetate with a $C_{10}$–$C_{24}$ aliphatic primary amine; and (b) a keto-ester formed by transesterification of an alkyl acetoacetate with a compound selected from the group consisting of $C_{10}$–$C_{24}$ aliphatic primary alcohols, $C_{10}$–$C_{24}$ hydroxy-substituted aliphatic hydrocarbyl sulfides, ethoxylated $C_{10}$–$C_{24}$ primary aliphatic amines and ethoxylated $C_{10}$–$C_{24}$ primary aliphatic ether amines.

The keto-esters referred to in subparagraph (b) above are all considered to be novel compounds and thus constitute further embodiments of this invention.

The alkyl acetoacetates used in forming the friction modifiers of the present invention may be represented by the formula $R_1C(:O)CH_2C(:O)OR_2$ wherein $R_1$ and $R_2$ are $C_1$–$C_{12}$ (meaning 1 to 12 carbon atoms) alkyl, preferably methyl or ethyl. A preferred compound for use in preparing the friction modifiers in accordance with the present invention is ethyl acetoacetate (EAA) which normally exists as a tautomer in both keto and enol forms. Methyl acetoacetate is also preferred.

The keto amide friction modifier is formed by reacting the alkyl acetoacetate with a $C_{10}$–$C_{24}$ aliphatic primary amine where the $C_{10}$–$C_{24}$ hydrocarbyl is branched or straight chain alkyl or alkenyl. This reaction may be carried out at about 100° C. for about 2 hours and for another 2 hours at about 150° C. Approximately, equimolar amounts of amine and alkyl acetoacetate are employed. Preferred amines are a mixture of $C_{11}$–$C_{14}$ tertiary alkyl primary amines (particularly those sold as Primene 81R) as well as oleyl amine.

The second general category of friction modifiers for use in the present invention are the keto esters formed by transesterification of an alkyl acetoacetate. These friction modifiers are considered novel compounds. The first keto ester friction modifier is formed by the transesterification of an alkyl acetoacetate with a $C_{10}$–$C_{24}$ aliphatic primary alcohol. The $C_{10}$–$C_{24}$ group may comprise a branched or straight chain alkyl or alkenyl group. This may be prepared by reacting equimolar quantities of the alcohol and the acetoacetate at about 100° C. under nitrogen over a period of about 4 hours. The preferred compound is the product formed by the transesterification of ethyl acetoacetate with oleyl alcohol.

The next friction modifier is that formed by the transesterification of a $C_{10}$–$C_{24}$ hydroxy-substituted aliphatic hydrocarbyl (branched or straight chain alkyl or alkenyl) sulfide with an alkyl acetoacetate. This reaction may be carried out by reacting equimolar quantities at 100° C. for about 2 hours and then for an additional 2 hours at about 150° C. Particularly preferred is the friction modifier formed by the transesterification of 2-hydroxyethyldodecyl sulfide with ethyl acetoacetate.

The next category of friction modifier in accordance with this invention is the product formed by the transesterification of an ethoxylated $C_{10}$–$C_{24}$ branched or straight chain alkyl or alkenyl primary aliphatic amine with an alkyl acetoacetate. The degree of ethoxylation will be 1–6, preferably about 2, moles of ethylene oxide per mole of amine. The product may be formed by reacting a molar equivalent of alkyl acetoacetate per each molar equivalent of hydroxy functionality in the ethoxylated amine. This reaction may be carried out at 2 hours at 100° C. and for an additional 2 hours at 150° C. until the distillation of ethanol comes to an end. The preferred embodiment is a product formed by the transesterification of the 2 mole ethoxylate of di-tallow amine with ethyl acetoacetate.

The last friction modifier embodiment of this invention is the product formed by the transesterification of ethoxylated ether primary aliphatic C10–C24 straight chain or branched alkyl or alkenyl amine with an alkyl acetoacetate. The degree of ethoxylation will be 1–6, preferably about 2, moles of ethylene oxide per mole of ether amine. The molar ratio is again 1 molar equivalent of alkyl acetoacetate per each molar equivalent of hydroxyl functionality in the ether amine. This reaction is also carried out at 100° C. for about 2 hours and for an additional 2 hours at 150° C. until the ethanol distillation ceases. The preferred embodiment for this friction modifier is the product formed by the transesterification of the 2 mole ethoxylate of a mixture of $C_{16}$–$C_{18}$ alkyl primary ether amines and ethyl acetoacetate.

Generally speaking, these friction modifiers are used in lubricating oils in amount from 0.05 to 2%, preferably 0.02 to 1% and most preferably 0.3 to 0.5% by weight.

Natural oils useful as basestocks in this invention include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Alkylene oxide polymers and interpolymers and derivatives thereof where the terminal hydroxyl groups have been modified by esterification, etherification, etc., are a class of known synthetic lubricating oils useful as basestocks in this invention. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils useful in this invention comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tertbutylphenyl) silicate, hexa-( 4-methyl-2-pentoxy) disiloxane, poly(methyl) siloxanes and poly (methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improved one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The compositions of this invention are principally used in the formulation of crankcase lubricating oils for passenger car engines. The additives listed below (including any additional friction modifiers) are typically used in such amounts so as to provide their normal attendant functions. Typical amounts for individual components are also set forth below. All the values listed are stated as mass percent active ingredient in the total lubricating oil composition.

| ADDITIVE | MASS % (Broad) | MASS % (Preferred) |
|---|---|---|
| Ashless Dispersant | 0.1–20 | 1–8 |
| Metal Detergents | 0.1–15 | 0.2–9 |
| Corrosion Inhibitors | 0–5 | 0–1.5 |
| Metal Dihydrocarbyl Dithiophosphate | 0.1–6 | 0.1–4 |
| Anti-oxidant | 0–5 | 0.01–3 |
| Pour Point Depressant | 0.01–5 | 0.01–1.5 |
| Anti-foaming Agent | 0–5 | 0.001–0.15 |
| Supplemental Anti-wear Agents | 0–5 | 0–2 |
| Additional Friction Modifier | 0–5 | 0–1.5 |
| Viscosity Modifier | 0.01–6 | 0–4 |

The individual additives may be incorporated into a basestock in any convenient way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is conveniently made in accordance with the method described in U.S. Pat. No. 4,938,880. That patent describes making a pre-mix of ashless dispersant and metal detergents that is pre-blended at a temperature of at least about 200° C. Thereafter, the pre-mix is cooled to at least 85° C. and the additional components are added.

The final crankcase lubricating oil formulation may employ from 2 to 20 mass % and preferably 4 to 15 mass % of the concentrate of additive package with the remainder being base stock.

Ashless dispersants maintain in suspension oil insolubles resulting from oxidation of the oil during wear or combustion. They are particularly advantageous for preventing the precipitation of sludge and the formation of varnish, particularly in gasoline engines.

Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is an $\alpha,\omega$-diene, such as a $C_3$ to $C_{22}$ non-conjugated diolefin (for example, a copolymer of isobutylene and butadiene, or a copolymer of ethylene, propylene and 1,4 -hexadiene or 5-ethylidene-2-norbornene). Preferred are polyisobutenyl (Mn 400–2500, preferably 950–2200) succinimide dispersants.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic ester, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents may be present and these function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Other friction modifiers include oil soluble amines, amides, imidazolines, amine oxides, amidoamines, nitrites, alkanolamides, alkoxylated amines and ether amines and polyol esters, esters of polycarboxylic acids, molybdenum compounds and the like.

Detergents that may be used include oil-soluble neutral and overbased sulfonates, phenates, sulfurized phenates, thiophosphonates, salicylates, and naphthenates and other oil-soluble carboxylates of a metal, particularly the alkali, e.g., sodium, potassium, lithium and magnesium. Preferred are neutral or overbased calcium and magnesium phenates and sulfonates.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts (ZDDP) are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors or antioxidants reduce the tendency of basestocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oils soluble phenates and sulfurized phenates, phosphosulfurized or sulfurized hydrocarbons, phosphorous esters, metal thiocarbamates, oil soluble copper compound as described in U.S. Pat. No. 4,867,890, and molybdenum containing compounds.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4-thiadiazoles such as those described in U.S. Pat. Nos. 2,719,125; 2,719,126; and 3,087,932; are typical. Other similar material are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in U.K. Pat. Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil improvers, lower the minimum temperature at which the fluid will flow or can be poured. Such additives are well known. Typical of those additives which improve the low temperature fluidity of the fluid are $C_8$ and $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The invention is further illustrated by the following examples which are not to be considered as limitative of its scope. All percentages are by weight, "a.i." refers to the active ingredient content of an additive without regard for carrier or diluent oil.

The high frequency reciprocating rig (HFRR) was used to evaluate the coefficient of friction characteristics of the oils. The instrument is called the AUTOHFR and is manufactured by PCS Instruments. The test protocol is shown in the table below.

HFRR Protocol

| Contact | 6 mm. Ball on 10 mm. Disc |
|---|---|
| Load, N | 10 |
| Stroke Length, Mm | 1 |
| Frequency, Hz. | 20 |
| Temperatures, C. | 40, 60, 80, 100, 120, 140 |
| Time per Stage, min. | 5 |

EXAMPLES

Examples 1–6

Preparation of Friction Modifiers

1. Trans-esterification of EAA (Ethyl Acetoacetate) with Oleyl alcohol 500 grams (1.86 mol) of commercially available oleyl alcohol and 241.8 g (1.86 mol) of EAA were charged into a reaction flask and heated slowly up to 100° C. while stirring under a mild nitrogen sweep. The ethanol by-product was collected by distillation using a Dean Stark trap. When most of the alcohol was collected the reaction temperature was allowed to go up to 150° C. to complete the reaction and strip any unreacted EAA. About 86 g of ethanol were collected after 4 hours of reaction. The IR shows the characteristic bands of the keto-ester structure and IR and GC analysis confirmed the distillate to be ethanol.

2. Trans-esterification of 2-hydroxyethyldodecyl sulfide (HEDDS)

In a similar manner as in example 1, 500 g (2.03) of HEDDS and 283 g (2.2 mol) of EAA were reacted for two hours at 100° C. and for another two hours at 150° C. About 94 grams of ethanol were collected by the end of the reaction. The IR of the product shows strong absorption band for the keto-ester structure. It analyzed for 9.56% sulfur, theoretical S is 9.70%.

3. Trans-esterification of ethoxylated (2 moles of ethylene oxide) di-tallow amine In a similar manner as example 1, 500 g (1.39 mol) of amine and 398 g (3.6 mol) of EAA were reacted for two hours at 100° C. and for another two hours at 150° C. until ethanol stops distilling off. The reaction mixture was then stripped at 160° C. for one hour to distill off the unreacted EAA. The IR spectrum confirmed the presence of the keto-ester structure. It analyzed for 3.25% N.

4. Trans-esterification of ethoxylated ether amine

In a similar manner as example 1, 500 g (1.2 mol) of ethoxylated (2 moles of ethylene oxide) $C_{16}$–$C_{18}$ ether amine and 344 g (3.6 mol) of EAA were reacted for two hours at 100° C. and for another two hours at 150° C. until ethanol stops distilling off. The reaction mixture was then stripped at 160° C. for one hour to distill off the unreacted EAA. The IR spectrum confirmed the presence of the keto-ester structure. It analyzed for 2.6% N.

5. Keto-amide derived from Primene 81R and EAA 500 g (2.63 mole) of Primene 81R (mixed $C_{11}$–$C_{14}$ tertiary alkyl primary amines) and 368 g (2.83 mol) of EAA were charged into a reaction flask and slowly heated up to 100° C. for two hours and for another two hours at 150° C. The end of the reaction collected about 120 g of ethanol. The reaction mixture was then stripped at 160° C. for one hour and collected. The Infrared spectrum shows a strong absorption band for the desired keto-amide structure. The stripped product analyzes for 5.3% N, theoretical N is 5.12%.

6. Keto-amide derived from Oleyl amine and EAA

In a similar manner as example 5, 500 g (1.83 mol) of Oleyl amine and 260 g (2.0 mol) of EAA were reacted at 100° C. for two hours and at 150° C. for another two hours. 85 g of ethanol was collected. The product was stripped at 160° C. and collected. The infrared spectrum showed a strong adsorption band for the keto-amide structure. It analyzes for 3.83% N.

Example 7

Friction Studies

Each of the friction modifiers prepared in Examples 1–6 was evaluated in the oils at a concentration of 0.4% by weight. Oil A comprised 4.0% Mn 2100 polyisobutenyl succinimide dispersant (64% a.i.), 1.5% overbased calcium sulfonate (55% a.i.), 0.5% sulfurized calcium phenate (46% a.i.), 0.3% neutral calcium sulfonate (57% a.i.), 0.5% dinonyl diphenyl amine, 0.2% sulfurized molybdenum antioxidant (47% a.i.), 0.58% ZDDP (75% a.i., from $C_8$ and $C_4$ alcohols), 0.58% of a second ZDDP (74% a.i., from $C_4$ and $C_5$ alcohols), 8.8% olefin copolymer viscosity modifier and the balance a mineral oil. Oil B was the same as Oil A except the overbased calcium sulfonate was replaced with 1.18% of overbased magnesium sulfonate (58% a.i.), HFRR data is in the table below. In certain cases, the friction modifier performs better in a magnesium-containing oil. A low coefficient of friction at high temperature, e.g., 120° C. or 140° C., shows a reduction in boundary friction attributable to the friction modifier.

HFRR Coefficient of Friction

| Friction Modifier & Oil | 40° C. | 60° C. | 80° C. | 100° C. | 120° C. | 140° C. |
|---|---|---|---|---|---|---|
| Example 1 and Oil A | 0.146 | 0.149 | 0.154 | 0.152 | 0.124 | 0.084 |
| Example 1 and Oil B | 0.156 | 0.162 | 0.164 | 0.155 | 0.153 | 0.160 |
| Example 2 and Oil A | 0.146 | 0.150 | 0.157 | 0.131 | 0.106 | 0.097 |
| Example 2 and Oil B | 0.160 | 0.167 | 0.174 | 0.179 | 0.178 | 0.176 |
| Example 3 and Oil A | 0.141 | 0.133 | 0.124 | 0.117 | 0.110 | 0.101 |
| Example 3 and Oil B | 0.152 | 0.148 | 0.146 | 0.149 | 0.145 | 0.140 |
| Example 4 and Oil A | 0.143 | 0.147 | 0.146 | 0.149 | 0.136 | 0.125 |
| Example 4 and Oil B | 0.150 | 0.154 | 0.155 | 0.159 | 0.157 | 0.150 |
| Example 5 and Oil A | 0.153 | 0.155 | 0.157 | 0.158 | 0.127 | 0.093 |
| Example 5 and Oil B | 0.155 | 0.171 | 0.177 | 0.181 | 0.180 | 0.163 |
| Example 6 and Oil A | 0.146 | 0.146 | 0.147 | 0.148 | 0.150 | 0.152 |
| Example 6 and Oil B | 0.155 | 0.164 | 0.166 | 0.167 | 0.167 | 0.156 |

What is claimed is:

1. A lubricating oil composition which comprises an oil of lubricating viscosity and a friction modifier selected from the group consisting of a) a keto-amide formed by reacting an alkyl acetoacetate with a $C_{10}$–$C_{24}$ aliphatic primary amine; and b) a keto-ester formed by transesterification of an alkyl acetoacetate with a compound selected from the group consisting of $C_{10}$–$C_{24}$ aliphatic primary alcohols, $C_{10}$–$C_{24}$ hydroxy-substituted aliphatic hydrocarbyl sulfides, ethoxylated $C_{10}$–$C_{24}$ primary aliphatic amines and ethoxylated $C_{10}$–$C_{24}$ primary aliphatic ether amines.

2. The composition of claim 1 where the composition further comprises an ashless dispersant.

3. The composition of claim 1 or claim 2 where the composition further comprises an overbased calcium or magnesium sulfonate.

4. The composition of claim 2 where the composition further comprises a zinc hydrocarbyl dithiophosphate.

5. The composition of claim 2 where the composition further comprises a viscosity modifier.

6. A keto-ester formed by transesterification of an alkyl acetoacetate with a compound selected from the group consisting of $C_{10}$–$C_{24}$ hydroxy-substituted aliphatic hydrocarbyl sulfides, ethoxylated $C_{10}$–$C_{24}$ primary aliphatic amines and ethoxylated $C_{10}$–$C_{24}$ primary aliphatic ether amines.

7. The keto-ester of claim 6 where the alkyl acetoacetate is methyl or ethyl acetoacetate.

8. The keto-ester of claim 6 where the hydrocarbyl sulfide is 2-hydroxy ethyldodecylsulfide.

9. The keto-ester of claim 6 where the ethoxylated primary amine is the 2 mole ethoxylate of di-tallow amine.

10. The keto-ester of claim 6 wherein the ethoxylated ether amine is the 2 mole ethoxylate of a mixture of $C_{16}$–$C_{18}$ primary ether amines.

* * * * *